United States Patent [19]

Dzomba

[11] Patent Number: 4,563,545

[45] Date of Patent: Jan. 7, 1986

[54] HIGH VOLTAGE OUTDOOR BUSHING EMPLOYING FOAM BODY SEAL AND PROCESS FOR MANUFACTURE THEREOF

[75] Inventor: James C. Dzomba, Ewing Township, Mercer County, N.J.

[73] Assignee: BBC Brown Boveri Inc., New York, N.Y.

[21] Appl. No.: 574,842

[22] Filed: Jan. 30, 1984

[51] Int. Cl.[4] ..... H01B 17/26

[52] U.S. Cl. ..... 174/152 R; 29/631; 174/209; 264/46.5; 264/264

[58] Field of Search ..... 174/18, 31 R, 80, 142, 174/143, 152 R, 153 R, 209; 29/631; 264/46.5, 262, 263, 264

[56] References Cited

U.S. PATENT DOCUMENTS

| | | | |
|---|---|---|---|
| 3,001,005 | 9/1961 | Sonnenberg | 174/142 |
| 3,242,446 | 3/1966 | Leute | 174/152 R X |
| 3,515,799 | 6/1970 | Ristuccia et al. | 174/153 R |
| 3,585,278 | 6/1971 | Quirk | 174/152 R |

FOREIGN PATENT DOCUMENTS 526842 9/1972 Switzerland .

OTHER PUBLICATIONS

Trade Publication by Mikafil AG Zurich Schweiz of Postfach CH-8048 Zurich, Switzerland, publication No. J 4307/1, pp. 1-6.

*Electrical World,* "Bushing", Jun. 16, 1969, pp. 49 and 50.

*Primary Examiner*—Laramie E. Askin

*Attorney, Agent, or Firm*—Ostrolenk, Faber, Gerb & Soffen

[57] ABSTRACT

A high voltage bushing has a central conductor which is surrounded by an insulation bushing core. The outer end of the conductor is bare and extends beyond the end of the bushing core. A mounting flange is also secured to the bushing core. One end of a hollow porcelain weathershed is fitted over the outer end of the central conductor and bushing core and seats against the mounting flange and defines an annular volume between the interior of the porcelain weathershed and the exterior of the bushing core. The bushing core is tapered down toward its end so that the annular volume within the weathershed has a tapered outer surface. The free end of the porcelain weathershed receives a bushing cap which seals the annular volume and can be bolted against the porcelain weathershed by a nut which is threaded onto the outer end of the conductor. The sealed volume is filled in situ by foaming a foamable material within the sealed annular volume, with the sealed volume serving as a mold to confine the foam form which is produced. The foam form is of a self-supporting, but slightly compressible, high dielectric material with foam cells filled with sulfur hexafluoride. A relief opening in the bushing cap permits excess foam to be released from the interior volume during the foaming process. The free-standing foamed body can be removed from the volume and replaced during maintenance or replacement of the bushing. The weathershed can be removed from the bushing core to allow easy removal and replacement of current transformers.

11 Claims, 3 Drawing Figures

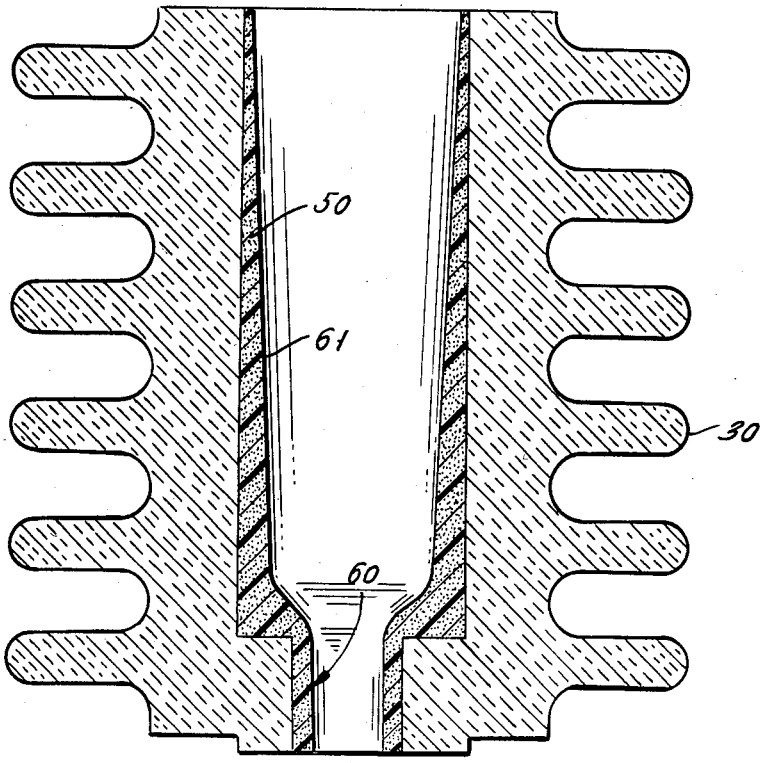
FIG. 2.
FIG. 3.
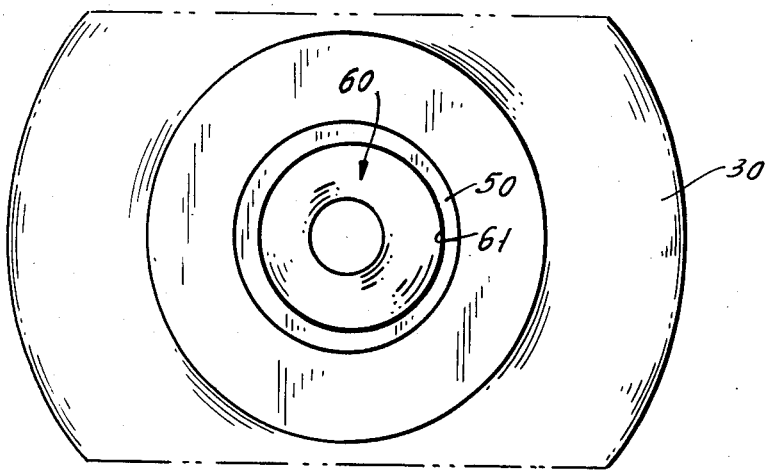

HIGH VOLTAGE OUTDOOR BUSHING EMPLOYING FOAM BODY SEAL AND PROCESS FOR MANUFACTURE THEREOF

BACKGROUND OF THE INVENTION

This invention relates to high voltage bushings, and more specifically relates to a novel structure and process for sealing the interior of a porcelain weathershed which is fixed to the end of an outdoor bushing.

High voltage outdoor bushings are well known wherein the bushing consists of a central conductor having a surrounding bushing core of insulation material. A mounting flange is fixed to the bushing core for mounting the bushing. A bushing of this type can be used for indoor application. When the bushing is to be used for outdoor application, however, a porcelain weathershed is connected over the end of the bushing and forms a sealed volume which encloses the bushing core and the flange. The free end of the central conductor extends through the weathershed so that electrical connection can be made to the conductor.

It is necessary to suitably seal or insulate the interior volume within the porcelain weathershed to ensure against leakage of moisture into this volume. Moisture in this interior volume creates an interior flashover or tracking path which is electrically parallel with the long path over the exterior surface of the porcelain weathershed. Thus, moisture in the interior volume prevents the bushing from operating at specified operating voltages.

Commonly, this interior volume is filled with a dry dielectric gas under pressure or with a high dielectric oil. It is, therefore, necessary to provide sealing means which will ensure against the accidental escape of the gas or liquid. Moreover, the seal must be designed so that it will contain the gas or liquid filling the volume even though the bushing components may expand differentially during temperature change. The use of gas or fluid for filling this volume also complicates maintenance procedures and installation and disassembly of the bushing and replacement of current transformers, since the gas or fluid can escape during these procedures.

In prior structures, the porcelain weathershed had an interior diameter which was not exactly concentric with the outer diameter of the bushing core. This non-concentricity further required a fluid-filled space between the non-concentric surfaces, and complicated the seal between the two insulators.

BRIEF DESCRIPTION OF THE INVENTION

In accordance with the present invention, the empty volume between a porcelain weathershed or other insulation shell and a central bushing core of an insulator bushing is filled with a slightly compressible insulation foam which is preferably foamed in situ, using the volume between the interior of the weathershed and the exterior of the bushing core as a mold for the formation of the foam body. The foam body is a self-supporting body which has a free volume which is slightly greater in dimension that the volume it is to fill so that the bushing core must be forced into the volume, thereby ensuring that all surface regions of the volume will be foam-covered. The volume is so designed that the weathershed and foam form can be removed from the bushing core for maintenance, disassembly procedures, and can be easily replaced and the foam volume compressed during reassembly of the bushing. A suitable bushing cap may be clamped over the free end of the insulation shell or porcelain weathershed to apply compression force to the insulation shell. Preferably, the end of the bushing core is tapered to permit easy release from the weathershed.

The cells of the foam body can consist of any desired polymeric material such as an elastomer, resin or other electrical grade material suitable for foaming. This polymeric material is foamed with any desired dielectric gas such as an electronegative gas, such as sulfur hexafluoride. The final foamed body need be only slightly flexible or compressible. The foam body can be incompressible but it is preferably compressible to ensure against voids in the volume to be filled.

The use of the foam body will assist in the assembly procedure of the bushing in that the foam material will generally support a porcelain weathershed and automatically align it for proper seating and at the same time will seal the weathershed after the bushing cap is tightened. Thus, the weathershed and bushing core can be tightly connected to one another, even though their outer diameters are not perfectly concentric. When the interior of the foam body is tapered at the same angle as the taper of the bushing core, improved sealing will occur since the seal will become tighter as the foam body is driven forward over the tapered bushing core.

The basic bushing core design can be used for indoor application. The same bushing can be adapted to outdoor application by fixing a porcelain weathershed over its end as described above.

BRIEF DESCRIPTION OF THE DRAWINGS

FIG. 2 is a cross-sectional view of a weathershed similar to that of FIG. 1; and FIG. 3 is a plan view of the weathershed of FIG. 2 and emphasizes the non-concentricity between the inner diameter of the weathershed and the outer diameter of the bushing core.

DETAILED DESCRIPTION OF THE INVENTION

Figure 1:
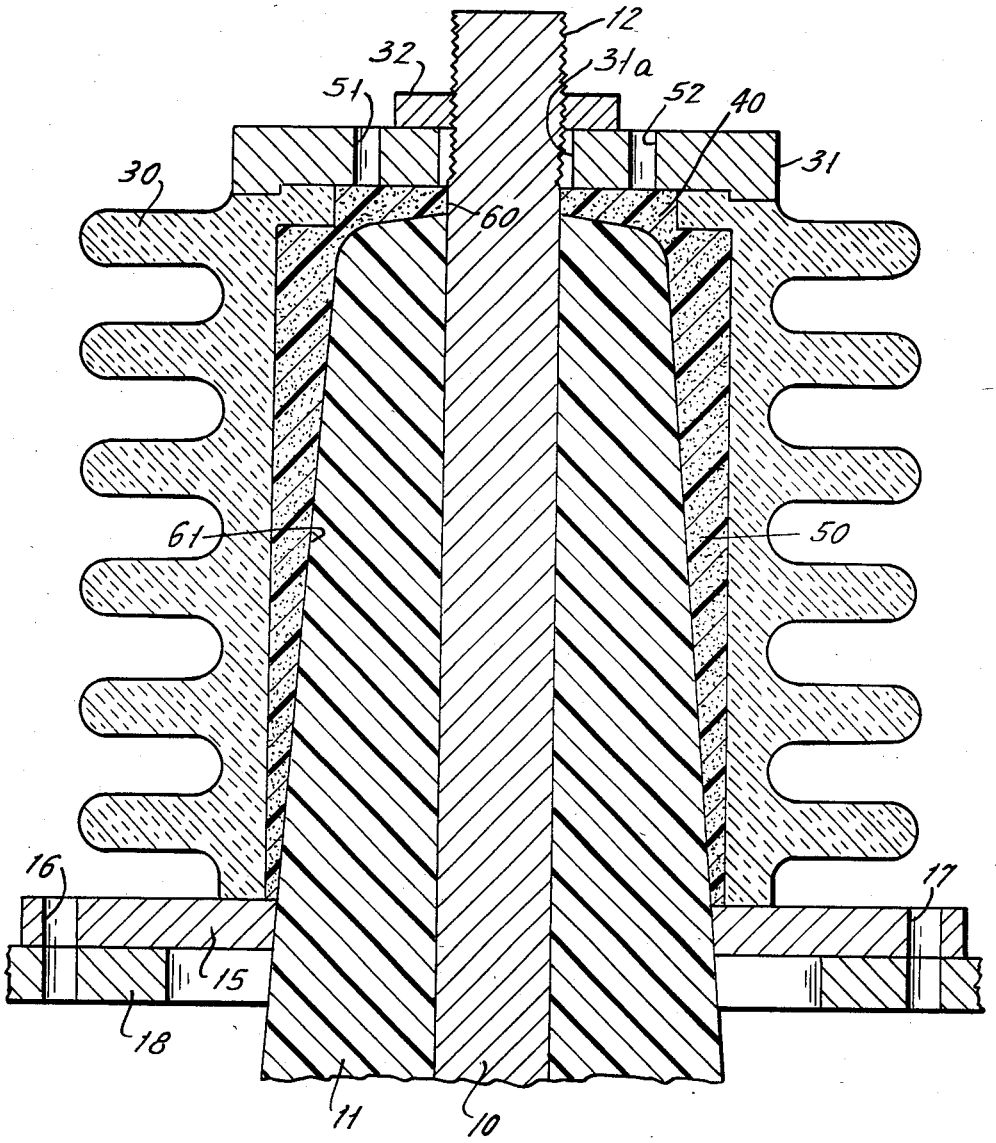
FIG. 1 is a cross-sectional view through one end of a bushing which is constructed in accordance with the present invention.

Referring first to FIG. 1, there is shown a portion of a bushing which is of generally well-known design, except for the novel foam body seal and method of manufacture which will be described. The bushing consists of a central conductor 10 which has a bushing core 11 formed thereon. The bushing core 11 can be an epoxy or can be of any other desired insulation material. Note that the conductor 10 extends beyond the end of bushing core 11, which is left free for suitable electrical connection. The free end of conductor 10 contains a thread 12 which will be later discussed.

A flange 15 may be formed as an integral extension of the body of core 11. Preferably, however, flange 15 is a steel ring, conventionally fixed to the bushing core 11. Bolt openings, such as openings 16 and 17, are formed in flange 15 to enable the connection of the flange 15, and thus of the entire bushing to be described, to the conductive wall 18 of the enclosure of electrical apparatus which is connected to one end of conductor 10. The bushing can then be mounted for indoor application, with only bushing core 11 acting as the bushing insulation. This is possible in indoor application, when the bushing is not exposed to adverse environmental elements such as snow, rain and moisture, which would reduce the voltage rating of the bushing. If, however, the structure 18 is an outdoor structure, special provisions are required for the bushing which will be in the outside environment, as will be described. Note, however, that an important feature of the invention is that the same bushing core 11 can be used for either indoor or outdoor purposes.

A conventional porcelain weathershed 30, which can have any desired number of skirts (six are shown) depending on the voltage rating of the bushing, has one end thereof fixed against the flange 15. Its opposite end engages a conductive bushing cap 31 which has a central opening 31*a* sufficiently large to easily receive the outer threaded diameter of the central conductor 10. A nut 32 on the thread 12 can be tightened to press flange 15 against the porcelain weathershed 30.

The arrangement described above defines an annular volume 40 within the interior of porcelain weathershed 30. In prior art arrangements, volume 40 was filled with oil or some other fluid or gas to seal the volume against moisture which would form an interior or tracking path over the surface of bushing core 11 or the interior diameter of weathershed 30. These seals were required to adequately seal the volume 40 even though the various components of the bushing design may experience substantial differential dimension changes as temperature changes. The use of oil or other certain gases also creates the hazard of escape of these fluids to the external environment.

In accordance with the present invention, and as shown in FIG. 1, the volume 40 is filled with a slightly compressible dielectric foam body 50, which has the shape of the interior volume 40 and fills the volume. The exterior diameter of volume 40 is tapered as shown to permit easy removal and reconnection of weathershed 30 and bushing core 11.

A preferred method for forming the foamed body 50 consists of the formation of the body in situ, with the volume 40 serving as the mold for the formation of the body 50. Thus, the bushing cap 31 may have openings 51 and 52 therein, as shown in FIG. 1. A suitable polymeric material, such as an elastomer or resin or other electrical grade material suitable for foaming, is loaded into the volume 40 through opening 51 along with a suitable foaming agent such as a dielectric gas which might be sulfur hexafluoride or some other electronegative gas. The foam is then conventionally gelled at either room temperature or elevated temperature until the foam body 50 is formed and held under pressure within the volume 40. Openings 51 and 52 can serve as vents to permit release of excess foam which is formed during the in situ foaming process.

One suitable foaming operation which could be used is as follows:

The interior surface of porcelain weathershed 30 and the exterior surface of bushing core 11 are coated with a suitable mold release agent such as a silicone. A liquid polyurethane elastomer which is filled to a level of 30 percent its weight with molecular sieves loaded with sulfur hexafluoride gas is then injected into volume 40 through opening 51 of the bushing/porcelain weathershed of FIG. 1 which has been preheated to 80° C. The polyurethane/$SF_6$ mixture is injected into opening 51 until it appears at opening 52. The assembly is then placed in an oven and heated to 80° C. for 30 minutes. This foams the polyurethane elastomer and gels the foam. The assembly can remain in the oven for 6 hours to completely cure, or the assembly may be removed from the oven and the foam allowed to cure at ambient temperature for 7 days.

One porcelain weathershed which was made in accordance with the invention is shown in FIGS. 2 and 3 and has a length of about 8 inches, an inner diameter of about 1½ inches and an outer diameter of 6 inches. Six skirts are used, having a thickness of ⅜ inch, and a center-to-center spacing of 1 inch. The wall thickness of insert 50 is about ⅛ inch, with this thickness varying by up to 1/16 inch when measured on opposite sides of its axis, due to non-concentricity between the bushing core 11 and the interior diameter of the weathershed 30 which serves as the mold.

The ultimately produced foam body 50, as shown in FIGS. 2 and 3, can, if desired, adhere to weathershed 30 or may be a free-standing body. Body 50 has a central opening 60 which receives conductor 10 extending from core 11. Its tapered interior wall 61 follows the shape of the tapered bushing core 11. An important feature of the invention is that the weathershed interior diameter may be out of round, or may be non-concentric (as in FIG. 3) with the bushing core 11, but this dimensional variation is easily and automatically compensated.

In order to install foam body 50, the bushing flange 15 (FIG. 1) is first clamped in place relative to the support wall 18 which is to support the bushing. Thereafter, the foam body 50 is pushed over the end of the bushing, although it will not slide fully down because it is expanded and its interior diameter is somewhat smaller than the diametrical portions of the bushing core which align with these interior diameter sections after the bushing is fully assembled.

Thereafter the interior of the porcelain weathershed 30 is coated with a silicone grease or some other suitable lubricant. The weathershed is then slipped onto the bushing core and can be pushed by hand about 95% of the full distance over the bushing core 11. Bushing cap 31 is then fixed in place and the nut 32 is tightened to drive the porcelain weathershed and free-standing insulation foam body 50 to their final sealed positions. Note that, in the above assembly operation, the porcelain weathershed 30 is automatically held concentrically relative to the central conductor 10.

An important advantage of the structure of the invention is that it simplifies the mounting and replacement of relatively small diameter current transformers on the bushing. Thus, as shown in co-pending application Ser. No. 396,776, filed July 9, 1982 in the name of Lorne D. McConnell et al., and entitled "Segmented Circuit Breaker Housing with Rotatably Adjustable Bushing Positions" and now issued as U.S. Pat. No. 4,440,998, current transformers are normally mounted inboard of the bushing weathershed of a terminal bushing. The invention makes it possible simply to remove the weathershed so that a small inside diameter current transformer can be slid over and off the bushing core for maintenance or replacement. After replacement of the current transformer on the bushing core, the weathershed is fixed in place and the bushing is operable.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. The process of manufacturing an insulation bushing of the type in which an elongated conductor has an insulation sheath thereon extending to an axial point on said elongated conductor and in which an insulation shell surrounds said end of said elongated conductor with said insulation sheath thereon and defines an annular volume surrounding said insulation sheath and a portion of said elongated conductor, said insulation sheath being tapered inwardly towards the outer end thereof so as to be removably situated in said insulation shell; said process comprising the steps of coating at least the exterior surface of said insulation sheath with a mold release agent so that said sheath becomes removably engaged to a foam placed in contact with the sheath, substantially sealing said annular volume, and thereafter injecting in situ a foamable fluid into said annular volume which forms a compressible self-supporting foam having good electrical insulation properties when it is gelled and which accommodates any non-concentricities between said insulation sheath and said insulation shell; and thereafter gelling said foamable fluid to cause it to expand into a foam body filling the interior of said annular volume, assuming the shape of said annular volume, and having a free volume which is slightly greater than said annular volume.

2. The process of claim 1 wherein said annular volume is generally symmetrical around the axis of said elongated conductor and has a conical exterior surface which reduces in diameter in the direction along said elongated conductor extending toward its said end.

3. The process of claim 1 wherein said insulation shell consists of a porcelain weathershed.

4. The process of claim 1 wherein said foam contains cells which are filled with an electronegative gas.

5. The process of claim 3 or 4 wherein said annular volume is generally symmetrical around the axis of said elongated conductor and has a conical exterior surface which reduces in diameter in the direction along said elongated conductor extending toward its said end.

6. An electrical bushing for high power, high voltage electrical apparatus; said bushing comprising an elongated conductor having a free terminal end, an insulation bushing core consisting of a sheath of insulation material which surrounds said elongated conductor and is coextensive therewith to an axial position removed from said free terminal end thereby to leave a given length of said free terminal end of said elongated conductor free of insulation, a mounting flange extending in a plane which is at an angle to the axis of said bushing core and fixed to said core at an axial location removed from the end of said bushing core, an insulation shell surrounding and radially spaced from said bushing core and having a first end engaging said mounting flange and having a second end disposed in a plane which generally includes a portion of said given length of said elongated conductor, and a bushing cap fixed to said second end of said insulation shell and extending thereacross to define a sealed volume defined by the annular space within said insulation shell and between said flange and said bushing cap; the improvement comprising a compressible insulation foam form having a free volume which is slightly greater than said sealed volume; said foam form being in situ-formed so as to accommodate any non-concentricities between said bushing core and said insulation shell and being compressed into and sealing the free space within said sealed volume while releasably engaging said bushing core, and said bushing core with said conductor therein being so shaped as to be removable from said insulation shell.

7. The bushing of claim 6 wherein said foam form is a self-supporting body which is removable from said annular volume upon removal of said bushing cap, and is replaceable into said annular volume and is compressible therein by forces caused by clamping said bushing cap onto said second end of said insulation shell.

8. The bushing of claim 6 wherein the end region of said bushing core is tapered; the smaller diameter end of said bushing core disposed adjacent said free terminal end of said elongated conductor.

9. The bushing of claim 6 wherein said insulation shell is a porcelain weathershed.

10. The bushing of claim 9 wherein said foam form and weathershed are removable from said bushing core upon removal of said bushing cap, and are replaceable on said bushing core by clamping said bushing cap onto said second end of said insulation shell.

11. The bushing of claim 9 wherein the end region of said bushing core is tapered; the smaller diameter end of said bushing core disposed adjacent said free terminal end of said elongated conductor.

* * * * *